United States Patent [19]

Richter

[11] Patent Number: 4,720,089

[45] Date of Patent: Jan. 19, 1988

[54] DUAL FOLDING FORMER PRINTED PRODUCT FOLDING APPARATUS

[75] Inventor: Johannes Richter, Augsburg, Fed. Rep. of Germany

[73] Assignee: M.A.N.-Roland Druckmaschinen Aktiengesellschaft, Augsburg, Fed. Rep. of Germany

[21] Appl. No.: 883,076

[22] Filed: Jul. 8, 1986

[30] Foreign Application Priority Data

Jul. 20, 1985 [DE] Fed. Rep. of Germany ..... 3526059

[51] Int. Cl.[4] ..... B41L 43/10

[52] U.S. Cl. ..... 270/43; 493/458

[58] Field of Search ..... 270/41–51, 270/6–9, 12–15, 21.1, 32; 493/340, 363, 364, 365, 370, 324, 458

[56] References Cited

U.S. PATENT DOCUMENTS

| | | | |
|---|---|---|---|
| 1,676,882 | 7/1928 | Barber | 270/47 |
| 1,739,328 | 12/1929 | Roesen | 493/458 |
| 1,739,398 | 12/1929 | Jordhoy | 493/458 X |
| 3,942,782 | 3/1976 | Hermach | 270/6 |
| 3,948,504 | 4/1976 | Woessner et al. | 270/41 |
| 4,135,708 | 1/1979 | Faltin | 270/57 |
| 4,147,337 | 4/1979 | Bolza-Schunemann | 270/48 |
| 4,559,032 | 12/1985 | Fischer | 270/41 |

FOREIGN PATENT DOCUMENTS 2656267 10/1978 Fed. Rep. of Germany ..... 270/42

*Primary Examiner*—E. H. Eickholt

*Attorney, Agent, or Firm*—Frishauf, Holtz, Goodman & Woodward

[57] ABSTRACT

The dual former (1, 2) apparatus includes a central housing and support (7) within which is retained a central common drive train (8). Located symmetrically with respect to a center line (21) through the housing and support (7) are respective transport roller units (9–12), cutting cylinder units (13, 14) and distribution apparatus units (15, 16; 27, 28), all driven from the common drive train (8). Some (9, 10) of the units may be cantilevered from the central housing and support (7), others (11, 12, 13, 14) have their remote ends journalled in bearing plates (17, 18) secured to the central housing structure (7) while still others (15, 16, 27, 28) are journalled in bearing plates secured on a base (6) which can also support the central housing structure, for example by being a metal element to which the central housing structure is welded. Delivery of folded, cut and separated printed subject goods is, preferably, laterally of the central housing structure. The open arrangement is compact and provides for excellent accessibility of all components of the respective units for service or interchange, and, if necessary, coupled adjustment of rotary speed by exchange of gearing in the drive train accessible in the central common housing structure.

12 Claims, 4 Drawing Figures

DUAL FOLDING FORMER PRINTED PRODUCT FOLDING APPARATUS

REFERENCE TO RELATED PUBLICATION

"Atlas des Zeitungs- und Illustrationsdruckes" ("Atlas of Newspaper and Magazine Printing"), published by Polygraph-Verlag, by Alexander Braun, 1960, pp. 88 and 89.

Reference to related application, assigned to the assignee of the present invention, the disclosure of which is hereby incorporated by reference: U.S. Ser. No. 883,077, filed July 18, 1986, RICHTER.

The present invention relates to a dual former folding apparatus to receive paper products, typically printed products from a printing machine, in web form, fold, transport and cut the printed webs and deliver the so-cut printed webs to distribution apparatus.

BACKGROUND

Various types of folding apparatus are known, see, for example, the referenced technical book "Atlas des Zeitungs- und Illustrationsdruckes" ("Atlas of Newspaper and Magazine Printing"), published by Polygraph-Verlag, by Alexander, Braun, 1960, pp. 88 and 89. One typical apparatus includes two folding formers which receive two webs of printed subject matter which are folded longitudinally by two folding formers. Each one of the folding apparatus has two parallel positioned side walls which retain the respective transport arrangements, folding cylinders and the like. The transport arrangements may be belts and/or transport rollers. One side of the side walls of each of the drive apparatus includes the drive train or drive structure for the respective one of the folding apparatus.

It has been found that use of two side walls for each folding apparatus is disadvantageous, since the respective parts are difficult to service; access to the various components of the folding apparatus is difficult, and, therefore, it is complicated to reach the respective transport or pulling rollers or devices, the folding cylinders, knife cylinders and the like. It is particularly difficult to exchange rollers, cylinders and the like which are journaled in the side walls. If two folding units are used in one double former folding apparatus, four side walls are required, and two drive trains and drive arrangements, one each at one of the side walls. This is complex and expensive, while being difficult to service due to impaired access.

THE INVENTION

It is an object to improve a dual or double former folding apparatus which is compact and in which the respective elements, such as pulling or transport devices, cutting or folding cylinders and the like, are readily accessible for service or exchange.

Briefly, a central support structure which defines a housing is provided from which respective rotating elements extend laterally in either direction. The respective folding formers or folding funnels are located above the transport, pulling, cutting and folding cylinders, that is, laterally of a center line passing, for example, through the central support structure. One shaft end of rotating elements such as a transport roller unit, a cutting cylinder unit, a distribution apparatus unit and the like, is journaled on the central support structure, which also retains the drive train to drive all the rotating apparatus; the other shaft ends can be supported on respective bearing plates supported, either, from a base, on which the central support structure may also be positioned, or separately, or from the central support structure itself. Since the two units extending centrally from the support structure will be essentially balanced, twisting forces on the central support structure are essentially eliminated.

DRAWINGS

DETAILED DESCRIPTION

Figure 1:
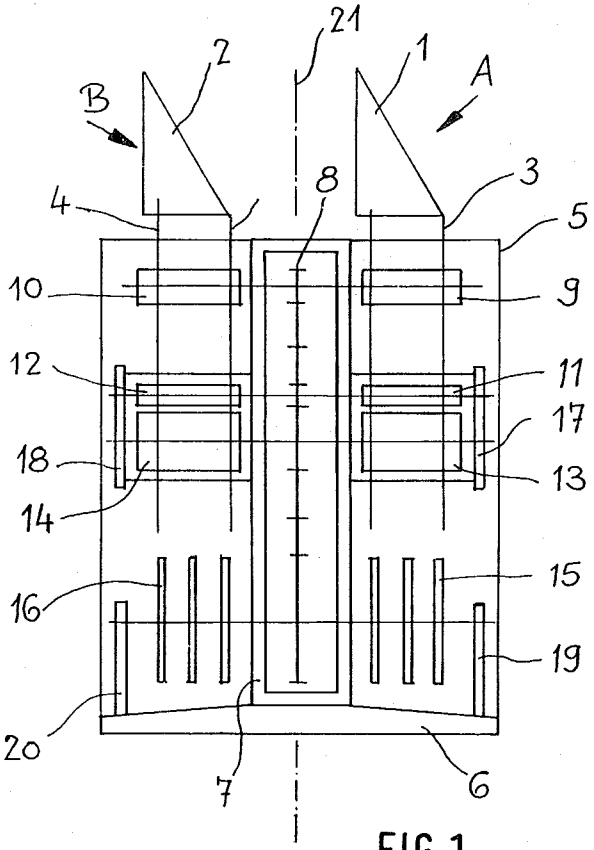
FIG. 1 is a schematic side view of the dual former folding and delivery apparatus, in which all elements which are conventional are shown schematically.
Figure 2:
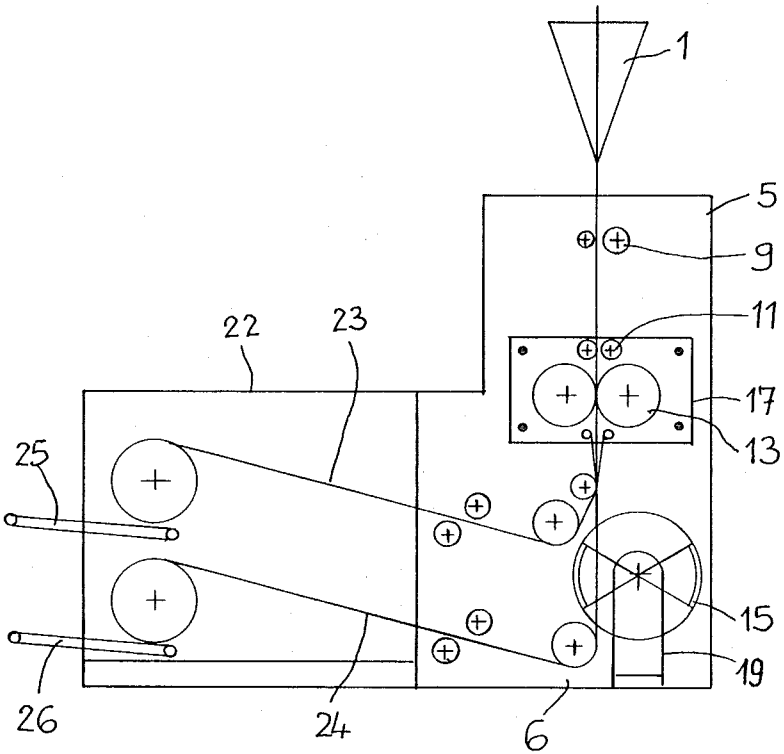
FIG. 2 is a front view of the apparatus of FIG. 1, looked at from the right side of the side view of FIG. 1.

FIGS. 1 and 2 show, respectively, a side view and a front view of a dual folding former apparatus. Two folding formers or folding triangles 1, 2 are located adjacent a center line 21 passing through the apparatus. The center line 21 also passes centrally through a central support structure 7, which is constructed in form of a housing.

Two webs 3, 4, for example received from a printing machine, are guided over the folding formers 1, 2. The folding formers themselves are shown only schematically and include standard folding former units generally designated as A, B, all auxiliary or accessory apparatus included in such units being standard and well known and of any suitable construction. Therefore, they have been omitted from the drawing for simplicity, and the designations A, B are intended to show that the folding units 1, 2 are complete, and of which only the folding funnels 1, 2 themselves are shown.

In the past, two separate folding apparatus units or assemblies were associated with each folding former structure A, B. This, as noted before, is expensive and space-consuming.

In accordance with the present invention, a single apparatus of dual folding former construction is used, shown, generally, at 5 in FIGS. 1 and 2. Such a single unit 5 has two formers 1, 2. A base 6 supports the single unit 5. The two folding former units A, B are located, respectively, on either side of the center line 21, symmetrically thereto, which line 21 passes through a central support and housing structure 7. The housing structure 7 retains a common drive train 8, for example a gear or sprocket belt- and gear drive the respective rotating components for processing the webs 3, 4. Preferably, the entire arrangement is located symmetrically with respect to the center line 21; the formers 1, 2 may be placed as illustrated if convenient for reception of the webs 3, 4 or either one of the folding formers 1, 2, or both, may be reversed right-for-left.

Pulling roller pairs 9, 10 are located beneath the respective folders 1, 2, as well known and as is customary. Cutting cylinders 13, 14 are located beneath the pulling roller pairs 9, 10, and beneath the cutting cylinders 13, 14 rotating deflection drums 15, 16 are located which form deflection or separating or distribution apparatus units to distribute the respectively cut and folded products derived from the webs 3, 4 into two different paths for delivery to separate delivery systems. Suitable distribution apparatus units are described in the copending application assigned to the assignee of the present application. U.S. Ser. No. 883,077, filed July 8, 1986, RICHTER.

In accordance with a feature of the invention, the respective pulling rollers 9, 10; 11, 12, cutting and folding cylinders 13, 14 and the delivery drums of the distribution apparatus units 15, 16 are journalled and supported on the central housing and support structure 7, extending, respectively, to the right and left thereof—see FIG. 1. The respective rotating elements may be journalled in the housing 7 by means of stub shafts or the like; the remote ends of the respective rollers, cylinders, or other rotating elements can be left unsupported—since balanced—as illustrated with respect to roller pairs 9, 10; alternatively, and if heavy, the respective remote ends may be journalled in bearing plates 17, 18 which can be supported from the central support and housing structure 7 or on bearing and support plates 19, 20 which can be supported from the base 6. The structure, consequently, is simple and compact. Additionally, and importantly, the respective rotating elements are readily accessible. It is thus easily possible to service or exchange any one of the component parts of the apparatus. The shafts can be short, and thus good stiffness with respect to twisting torques is obtained.

The open construction of the dual former apparatus 5 thus has the advantage of small space requirements, simple construction, and economical manufacture. In the embodiment of FIGS. 1 and 2, cut and folded printed subject goods, derived from the webs 3, 4, are supplied via supply belt systems 23, 24 to respective delivery transport belts 25, 26, extending from one side of the apparatus, for example within a housing portion or a zone 22.

The structure has the further advantage that the drive is simple since a single central drive train 8 is used in which, as well known, gears or sprockets can be easily exchanged for gears or sprockets of different size or pitch, or by addition of further gearing so that the cutting length of cutting cylinders 13, 14 of the webs and delivery speed can be easily matched, without requiring separate speed control drives which are far more expensive than interchangeable gears or sprockets.

Figure 3:
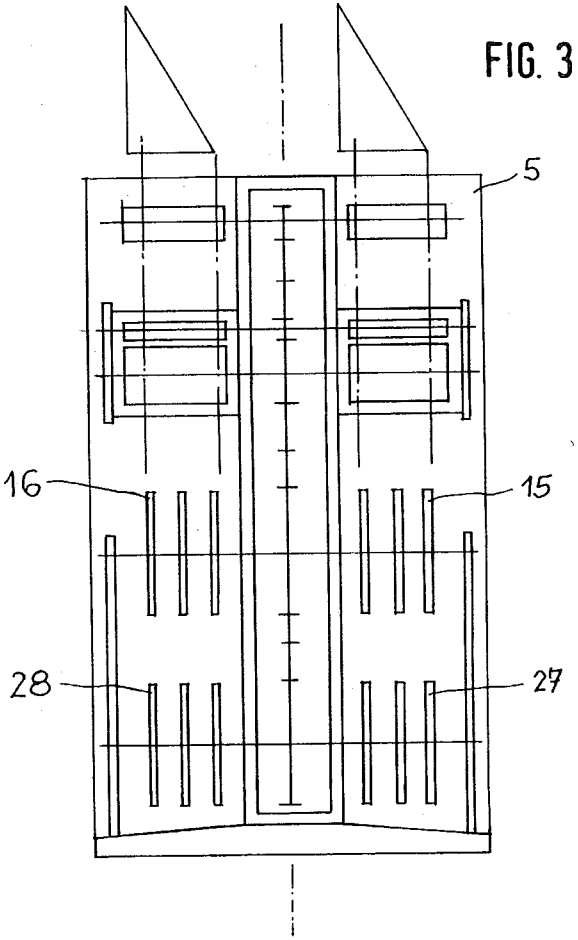
FIG. 3 is a view similar to FIG. 1 illustrating the arrangement with two distribution units, located above each other.
Figure 4:
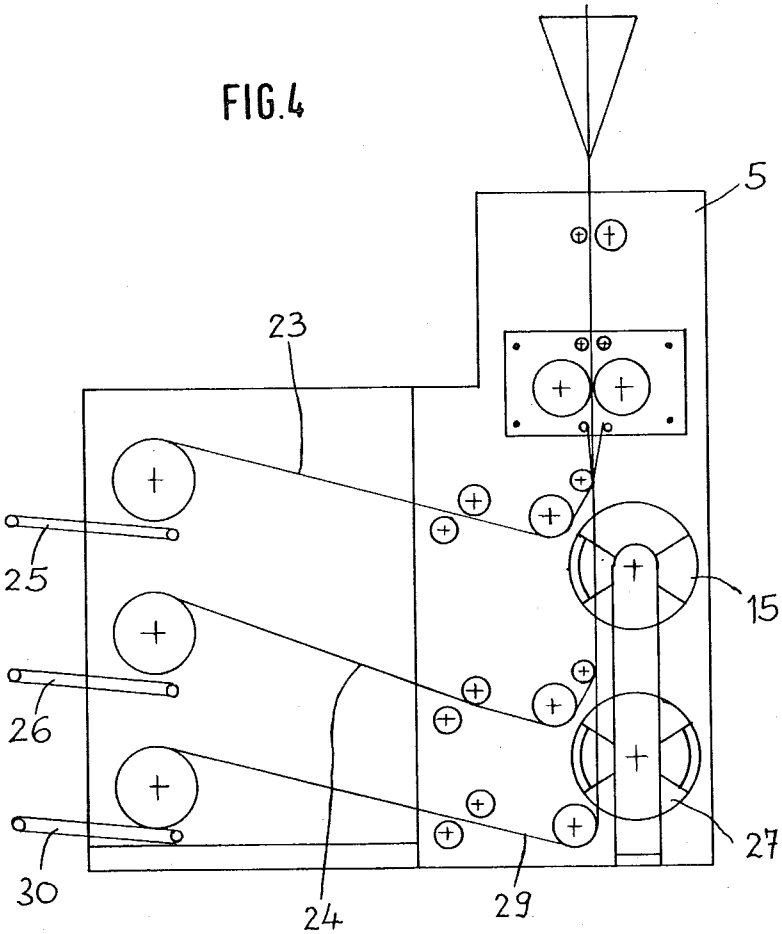
FIG. 4 is a front view of the apparatus of FIG. 3, taken similarly to FIG. 2.

The arrangement has the additional advantage that it can readily be constructed in modular form to permit delivery of folded products in accordance with specific requirements. Referring now to FIGS. 3 and 4, which illustrate how the arrangement can be expanded to deliver folded products on more than four delivery belts. As shown in FIG. 4, delivery belts 25, 26, 30—each duplicated in a plane parallel to the plane of the drawing of FIG. 4—provides, therefore, a total of six delivery stations or delivery belts. In accordance with the structure shown in FIGS. 3 and 4—where only those elements which are not identical to the ones in FIGS. 1 and 2 have been given reference numerals, further distribution units 27, 28 are provided, located beneath the distribution units 15, 16. Each one of the distribution units 27, 28 may be identical to, and located with respect to the center line 21, similarly to the units 15, 16, being driven from the common drive train 8. The arrangement permits further splitting of the cut, folded, printed subjects derived from the webs 3, 4. The cut, folded, printed subject matter can then be delivered to six delivery systems 25, 26, 30, each duplicated in the plane of the drawing of FIG. 4; a belt transport arrangement 29 transports the folded, printed goods destined for the third delivery system 30 thereto.

Of course, it is possible to utilize only one of the formers 1, 2, and the associated apparatus, if desired. Thus, versatility in use and selectivity of required apparatus is provided by this dual structure.

I claim:

1. Dual folding former and folded product delivery apparatus, for folding and transporting two supplied webs (3, 4), supplied to a respective one of two formers (1, 2) and delivery of folded, cut products, comprising a base (6);

a central support structure (7) defining a housing, located on said base;

one, each, folding assembly including one of said folding formers (1, 2);

at least one transport roller unit (9, 10, 11, 12);

a cutting cylinder unit (13, 14); and a distribution apparatus unit (15, 16), each of said units being rotatably journalled at one side on said housing support structure, extending, symmetrically, with respect to a center line (21) passing through said housing support structure;

a common drive means (8) coupled to said units (9, 10, 11, 12; 13, 14; 15, 16) retained in the housing structure (7);

bearing plates (17, 18, 19, 20), at least one of said units being journalled at a second side thereof on said bearing plates;

and at least two receiving means (25, 26) receiving folded, cut products from each of said distribution apparatus units, whereby two supplied webs (3, 4) will be folded, cut into two cut products and the two cut products distributed by two distribution apparatus units to two respective delivery means, each, and thereby to four separate receiving means.

2. The apparatus of claim 1, wherein the distribution units (15, 16) are located adjacent each other, in pairs, on either side of said housing support structure (7);

and wherein two receiving means, one each associated with a respective distribution apparatus unit, are located above each other to receive folded, cut and separated products from the respective distribution apparatus units.

3. The apparatus of claim 1, wherein at least one of said transport roller units comprises transport rollers (9, 10) supported solely on said housing support structure, each said transport roller units including a transport roller pair cantilevered from said housing support structure.

4. The apparatus of claim 1, wherein at least two of said bearing plates (17, 18) are secured to said central housing support structure, symmetrically, on either side of said central housing support structure.

5. The apparatus of claim 1 wherein at least two of said bearing plates (19, 20) are secured to said base (6), laterally on each side of the central housing support structure (7).

6. (upon printing to follow claim 4):

The apparatus of claim 1 wherein two of said bearing plates (17, 18) are secured to said central housing support structure, symmetrically, on either side of said housing support structure; and wherein two additional ones of said bearing plates (19, 20) are secured to said base (6) symmetrically laterally on either side of said central housing support structure (7).

7. Dual folding former and folded product delivery apparatus, for folding and transporting two supplied webs (3, 4), supplied to a respective one of two formers (1, 2) and delivery of folded, cut products, comprising a base (6);

a central support structure (7) defining a housing, located on said base;

one, each, folding assembly including one of said folding formers (1, 2);

at least one transport roller unit (9, 10, 11, 12);

a cutting cylinder unit (13, 14); and a distribution apparatus unit (15, 16; 27, 28), each of said units being rotatably journalled at one side on said housing support structure, extending, symmetrically, with respect to a center line (21) passing through said housing support structure;

a common drive means (8) coupled to said units (9, 10, 11, 12; 13, 14; 15, 16; 27, 28 ) retained in the housing structure (7);

bearing plates (17, 18, 19, 20), at least one of said units being journalled at a second side thereof on said bearing plates;

wherein the distribution apparatus units, each, comprise dual units (15, 27; 16, 28) respectively located above each other, and associated with a respective folding former (1, 2);

at least three receiving means (25, 26, 30) receiving folded, cut products from each of said distribution apparatus units, whereby three supplied (webs 3, 4) will be folded and cut, into three cut products and the three cut products distributed by three distribution apparatus units to three respective delivery means, each, and thereby to six separate receiving means (25, 26, 30).

8. The apparatus of claim 7, wherein the distribution units (15, 16 ; 27, 28 ) are located adjacent each other, in pairs, on either side of said housing support structure (7);

and wherein three receiving means, one each associated with a respective distribution apparatus unit, are located above each other to receive folded, cut and separated products from the respective distribution apparatus units.

9. The apparatus of claim 7, wherein at least one of said transport roller units comprises transport rollers (9, 10) supported solely on said housing support structure, each said transport roller units including a transport roller pair cantilevered from said housing support structure.

10. The apparatus of claim 7, wherein at least two of said bearing plates (17, 18) are secured to said central housing support structure, symmetrically, on either side of said central housing support structure.

11. The apparatus of claim 7 wherein at least two of said bearing plates (19, 20) are secured to said base (6), laterally on each side of the central housing support structure (7).

12. The apparatus of claim 7 wherein two of said bearing plates (17, 18) are secured to said central housing support structure, symmetrically, on either side of said housing support structure; and wherein two additional ones of said bearing plates (19, 20) are secured to said base (6) symmetrically laterally on either side of said central housing support structure (7).

* * * * *